US006637175B2

(12) United States Patent
Ghirlandi

(10) Patent No.: US 6,637,175 B2
(45) Date of Patent: Oct. 28, 2003

(54) METHOD AND MACHINE FOR WRAPPING INFUSION BAGS IN OUTER ENVELOPES

(75) Inventor: Dante Ghirlandi, Bologna (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 2 days.

(21) Appl. No.: 09/926,372

(22) PCT Filed: Feb. 19, 2001

(86) PCT No.: PCT/IB01/00217

§ 371 (c)(1),
(2), (4) Date: Oct. 22, 2001

(87) PCT Pub. No.: WO01/62600

PCT Pub. Date: Aug. 30, 2001

(65) Prior Publication Data

US 2002/0139087 A1 Oct. 3, 2002

(30) Foreign Application Priority Data

Feb. 22, 2000 (IT) ..... B02000A0080

(51) Int. Cl.[7] ..... B65B 29/04
(52) U.S. Cl. ..... 53/413; 53/134.2
(58) Field of Search ..... 53/134.2, 374.4, 53/374.8, 413, 479

(56) References Cited

U.S. PATENT DOCUMENTS 1,857,625 A * 5/1932 Doble ..... 53/134.2
3,566,573 A 3/1971 Irmscher
3,774,369 A * 11/1973 Klar ..... 53/134.2
4,288,224 A * 9/1981 Romagnoli ..... 493/345
4,731,974 A 3/1988 Billi
4,853,071 A 8/1989 Romagnoli
4,977,728 A * 12/1990 Rambold ..... 53/567
5,460,844 A 10/1995 Gaylor
5,871,789 A * 2/1999 Romagnoli ..... 426/77
6,499,273 B1 * 12/2002 Marzocchi ..... 53/413

FOREIGN PATENT DOCUMENTS

WO WO 97/41032 11/1997

* cited by examiner

*Primary Examiner*—Stephen F. Gerrity
*Assistant Examiner*—Nathaniel Chukwurah
(74) *Attorney, Agent, or Firm*—Arent Fox Kintner Plotkin & Kahn, PLLC

(57) ABSTRACT

A method and related machine for wrapping filter-bags (1) in sealed outer envelopes (S) comprises the following steps: feeding single, plane sheets (6) to a station (7) for wrapping each sheet (6) over a corresponding filter bag (1); folding the sheet (6) into a U-shape about a transversal axis (X) of the sheet (6) itself so as to form at least two opposite wings (6*a*, 6*b*) between which the filter bag (1) is placed; rolling the longitudinal edges (8*a*, 8*b*) of the U-shaped sheet (6) so as to flatten them; and, lastly, joining at least the longitudinal edges (8*a*, 8*b*) of the U-shaped sheet (6) to form a sealed outer envelope (S) around the filter bag (1).

22 Claims, 4 Drawing Sheets

METHOD AND MACHINE FOR WRAPPING INFUSION BAGS IN OUTER ENVELOPES

TECHNICAL FIELD

The present invention relates to a method for wrapping filter bags for products for infusion such as coffee, tea, camomile and the like in sealed outer envelopes and the machine that implements the method.

BACKGROUND ART

At present, machines for making filter bags comprise a plurality of stations, located one after the other, in which the filter bags are made. Each filter bag contains a charge of product closed in a corresponding chamber. Depending on the type of product it contains and the machine used to make it, the filter bag has one or two chambers and is joined in one of several different known ways (for example, by knotting, heat sealing or by means of a heat sealed stamp) to a string that connects it to a pick-up tag which is joined in one of several different known ways (for example, by knotting, heat sealing or by means of a stamp) to the free end of the string.

The string and the pick-up tag are suitably positioned on the filter bag thus made (for example wound around the bag and connected to it or tucked inside it) to form a product that as ready to be packed in suitable cartons or boxes.

Before groups of filter bags are packed in boxes, the filter bags may be individually wrapped in an outer envelope consisting of a sheet of wrapping material folded around each filter bag and heat sealed in one or two different ways: on at least two longitudinal sides or edges of the outer envelope if the latter has an opening flap folded over one of the surfaces of the envelope itself; or simultaneous heat sealing on three sides of the outer envelope, that is to say, two longitudinal edges and one transversal edge, if the envelope is of the simple type, that is to say, without the opening flap.

Known machines used to wrap the filter bags in individual outer envelopes have a filter bag handling station comprising a plurality of grippers mounted radially on a starwheel, each being designed to pick up a single filter bag. As the starwheel turns, the filter bags are carried to different stations where the string and tag are joined to each other and to the filter bag and then to an wrapping station where a web of wrapping material is cut into separate sheets, each of which will form the outer envelope of a corresponding filter bag.

Close to this station, the filter bag is moved radially away from the starwheel to enable the sheet of wrapping material to be fed between it and the starwheel. The filter bag is then moved close to the starwheel again to enable the sheet of wrapping material to be folded into a U shape around the filter bag. During this step, the opening flap of the outer envelope may also be formed by suitable folding means at the station, the flap being held in place by a presser element on the gripper elements on the starwheel.

After this, the filter bag with the sheet of wrapping material folded in a U shape around it, is carried to a sealing station where two or three edges of the sheet formed by the previous folding operation are sealed by suitable sealing means consisting of two or three elements depending on the type of outer envelope to be made.

The filter bag thus sealed in its outer envelope is then fed to the stacking and final cartoning stations.

This method, consisting in sealing the edges of the outer envelope after simply folding it, often results in a poor quality finish owing to the difficulty of correctly sealing the two longitudinal edges and, in the case of a simple outer envelope without opening flap, the transversal edge simultaneously. Indeed, during the folding step, the longitudinal edges in particular, are difficult to place squarely over each other since the wrapping material follows the shape of the filter bag which is not firm enough to enable a neat, square fold to be made. This results in skew seals and crinkling along the edges of the outer envelope which are not only unattractive but which also do not adequately protect the product inside. This problem is accentuated by the physical properties of the wrapping material from which the outer envelope is made and whose relative rigidity prevents it from keeping its shape before and after sealing.

DISCLOSURE OF THE INVENTION

The present invention has for an object to overcome the above mentioned problem by providing a method and a machine for wrapping filter bags in sealed outer envelopes in an extremely simple, fast and efficient manner without altering the general structure or existing machinery for this purpose, so as to make outer envelopes of good quality and ensuring a proper seal.

Accordingly, the invention provides a method for wrapping filter bags for products for infusion in individual sealed outer envelopes, the filter bags being of the type comprising at least one chamber containing a charge of product and a string connected at one end to the chamber itself, while the other end of the string is connected to a pick-up tag, the method comprising the following steps: feeding a succession of single, plane sheets to a station or wrapping each sheet over a corresponding filter bag; folding the sheet into a re-shape about a transversal axis of the sheet itself so as to form at least two opposite wings between which the filter bag is placed; and joining at least the longitudinal edges of the U-shaped sheet to form a sealed outer envelope around the filter bag; the method being characterised in that between the step of folding the sheet and the step of joining its longitudinal edges, it comprises a further step of rolling the longitudinal edges so as to flatten them.

The present invention also provides a machine for wrapping filter bags for products for infusion in individual sealed envelopes, the falter bags being of the type comprising at least one chamber containing a charge of product and a string connected at one end to the chamber itself, while the other end of the string is connected to a pick-up tag, the machine comprising handling means for moving each filter bag in a working direction towards a station for wrapping a single, plane sheet of wrapping material around the filter bag; means for folding the sheet of wrapping material about a transversal axis of it to form a U-shaped wrapping around the filter bag, with at least two opposite wings between which the filter bag is placed; and a station for joining at least two longitudinal edges of the U-shaped wrapping sheet to form a single sealed envelope around the filter bag; the machine further comprising between the wrapping station and the joining station a rolling station designed to flatten the longitudinal edges.

The technical characteristics of the invention, in accordance with the above-mentioned aims, are set out in the claims herein and the advantages more clearly illustrated in the detailed description which follows, with reference to the accompanying drawings, which illustrate preferred embodiments of the invention without restricting the scope of the inventive concept, and in which:

Figure 1:
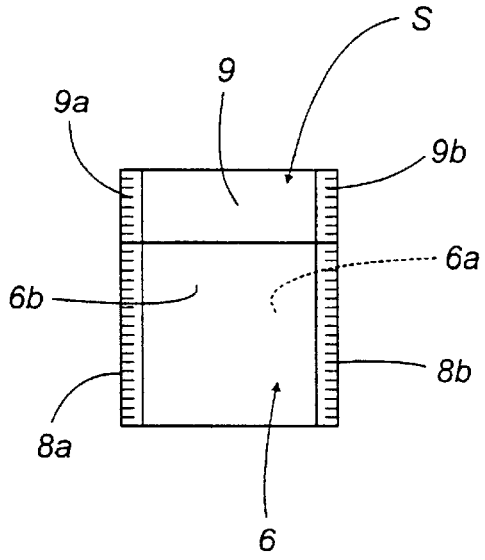
FIGS. 1 and 2 are front and perspective views showing a wrapping for a product for infusion with a sealed outer envelope, made using the method according to the present invention and having a front flap for opening the envelope itself.
Figure 2:
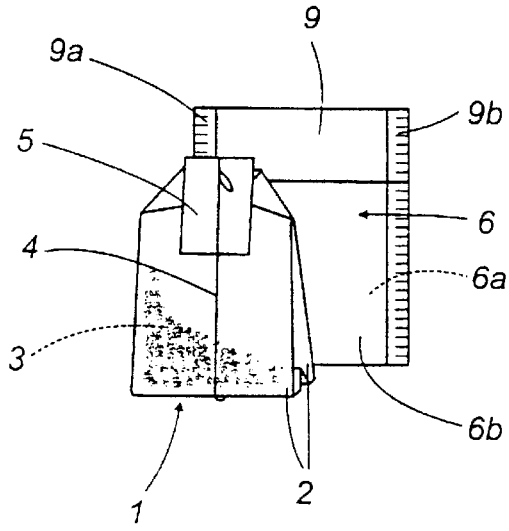
Figure 3:
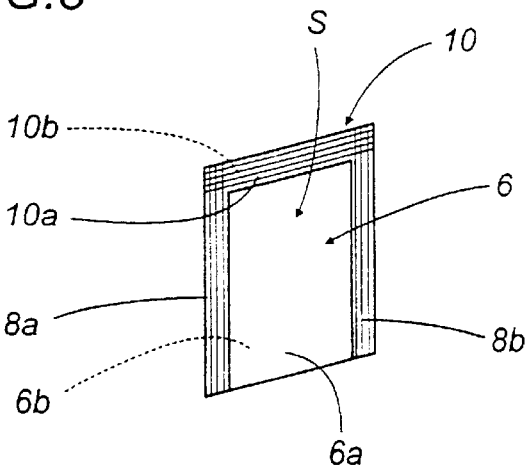
FIG. 3 is a front view of another wrapping for a product for infusion, with an outer envelope made using the method according to the present invention and sealed on three of its edges.

With reference to the accompanying drawings, in particular FIGS. 1 to 3, the method for wrapping filter bags in individual sealed outer envelopes can be used for filter bags 1 comprising one or two chambers 2, each containing a charge 3 of product and a string 4 connected at one end to the chamber or chambers 2 and a tag 5 connected to the other end of the string 4 (a double chamber filter bag is illustrated purely by way of example in FIG. 2).

As shown in FIGS. 1 to 4, the filter bag 1 is wrapped in a sealed outer envelope S made from a sheet 6 of paper or heat-sealable wrapping material or material having some parts with cold glue on them (as described in more detail below), which is folded into a U shape.

In a first wrapping style (see FIGS. 1 and 2), the sealed outer envelope S as made from a sheet 6 preferably of paper, folded into a U shape to form two wings 6*a* and 6*b*, between which the filter bag 1 is placed, and has an opening flap 9 formed by an extension of the wing 6*a* folded over itself and over the other wing 6*b*, and two longitudinal edges 8*a* and 8*b* made by joining the corresponding longitudinal edges of the wings 6*a* and 6*b* of the sheet 6.

In a second wrapping style (see FIG. 3), the sealed outer envelope S is made from a sheet 6 preferably of heat-sealable material or of material having parts with cold glue on them, folded into a U shape to form two wings 6*a* and 6*b* between which the filter bag 1 is placed. This wrapping has a top end 10 made by joining, preferably by heat sealing or by simply pressing, the transversal edges or ends 10*a* and 10*b* of the corresponding wings 6*a* and 6*b* of the sheet 6, and two longitudinal ends 8*a* and 8*b* made by joining, preferably by heat sealing or by simply pressing, the corresponding longitudinal edges or the wings 6*a* and 6*b*.

The wrapping method, implemented by the machine M illustrated in FIG. 4 as described in more detail below, comprises the following steps: feeding a succession of single, plane sheets, cut off from a web of wrapping material, to a station 7 for wrapping the sheets 6 around the filter bags 1; at the station 7, folding each sheet 6 about a transversal axis X of the sheet 6 to form a U-shaped wrapping around a corresponding filter bag 1 with at least two wings 6*a* and 6*b* facing each other; looking in more detail, the folding operation itself is performed in a known manner by lowering the filter bag 1, placing the sheet 6 between the filter bag 1 and suitable handling means 12, and then raising the filter bag 1 towards the means 12 (see arrows F3 and F4 in FIGS. 4 and 5); rolling the longitudinal edges 8*a* and 8*b* of the wings 6*a* and 6*b* of each U-shaped wrapping together on both sides of the U-shaped wrapping so as to flatten the longitudinal edges 8*a* and 8*b* and keep them aligned; joining the longitudinal edges 8*a* and 8*b* of the sheet 6 to a form a single, sealed outer envelope S containing a filter bag 1.

Figure 8:
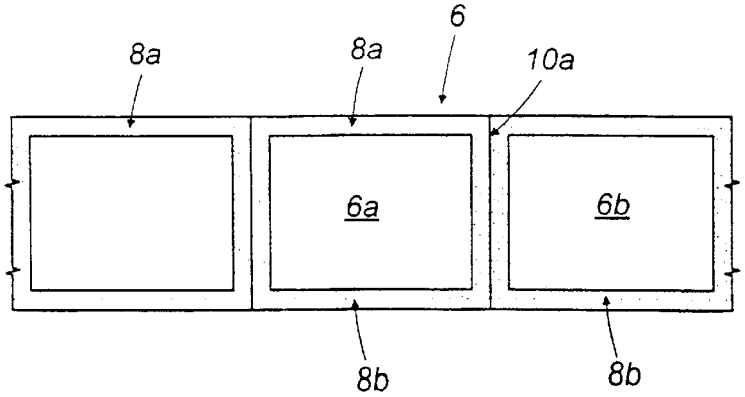
FIG. 8 is a schematic top plan view of a portion of a web of wrapping material used to make outer envelopes for filter bags having some parts with cold glue on them.

If sheets 6 with cold glue on the edges 8*a* and 8*b* and on the transversal ends 10*a* and 10*b* (as shown in FIG. 8) are being used, the rolling and joining steps are performed simultaneously since the rolling action also has the effect of pressing together the parts with the cold glue on them.

If the sheet 6 folded into a U shape includes the opening flap 9 (shown in FIGS. 1 and 2), previously formed according to a known method, which is not illustrated, during the step of folding the wings 6*a* and 6*b*, the rolling step is also applied to the outer edges 9*a* and 9*b* of the open flap 9 itself, so as to correctly align the outer edges 9*a* and 9*b* with the longitudinal edges 8*a* and 8*b* below them.

Figure 5:
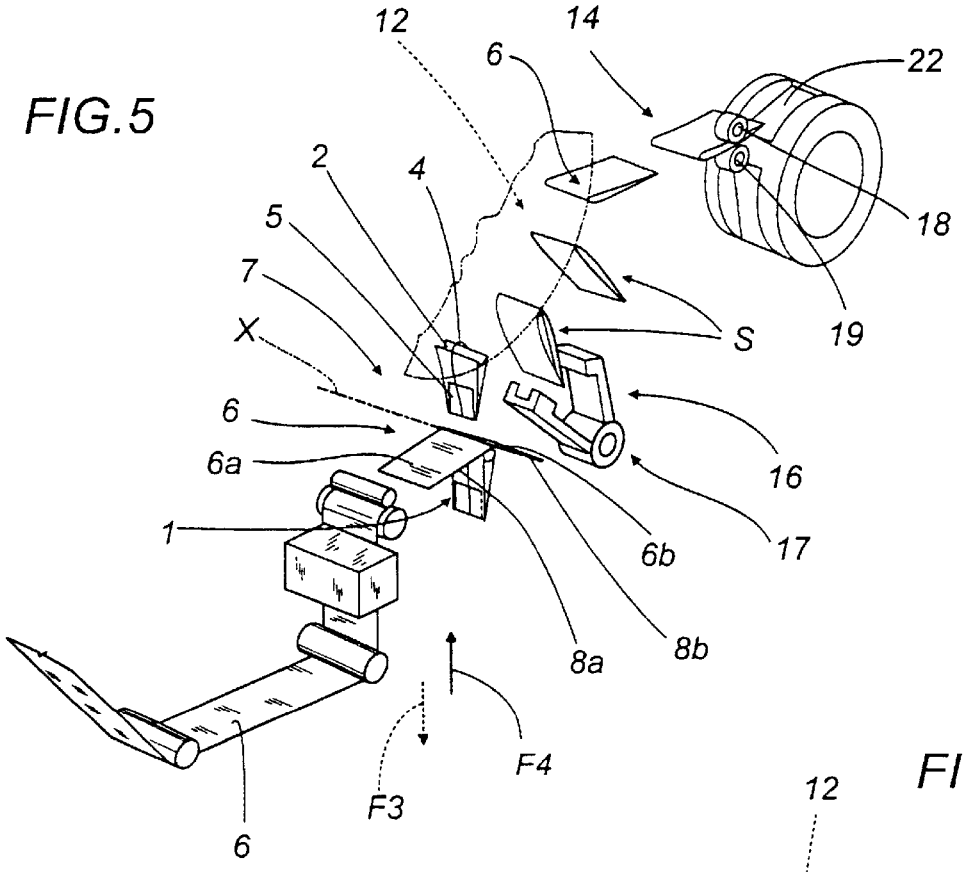
FIG. 5 is a partial perspective view of another embodiment of the machine illustrated in FIG. 4.

Instead, if the U-shaped sheet 6 is of the type illustrated in FIG. 3 to be joined preferably by heat sealing on three edges or sides, the method comprises a further step of joining the transversal edges 10*a* and 10*b* preferably by heat sealing before the step of rolling the longitudinal edges 8*a* and 8*b* of the wings 6*a* and 6*b* (see FIG. 5 in particular)

In this case too, if the transversal edges 10*a* and 10*b* have cold glue on them, the joining step is performed by simply pressing the edges 10*a* and 10*b* together.

Figure 4:
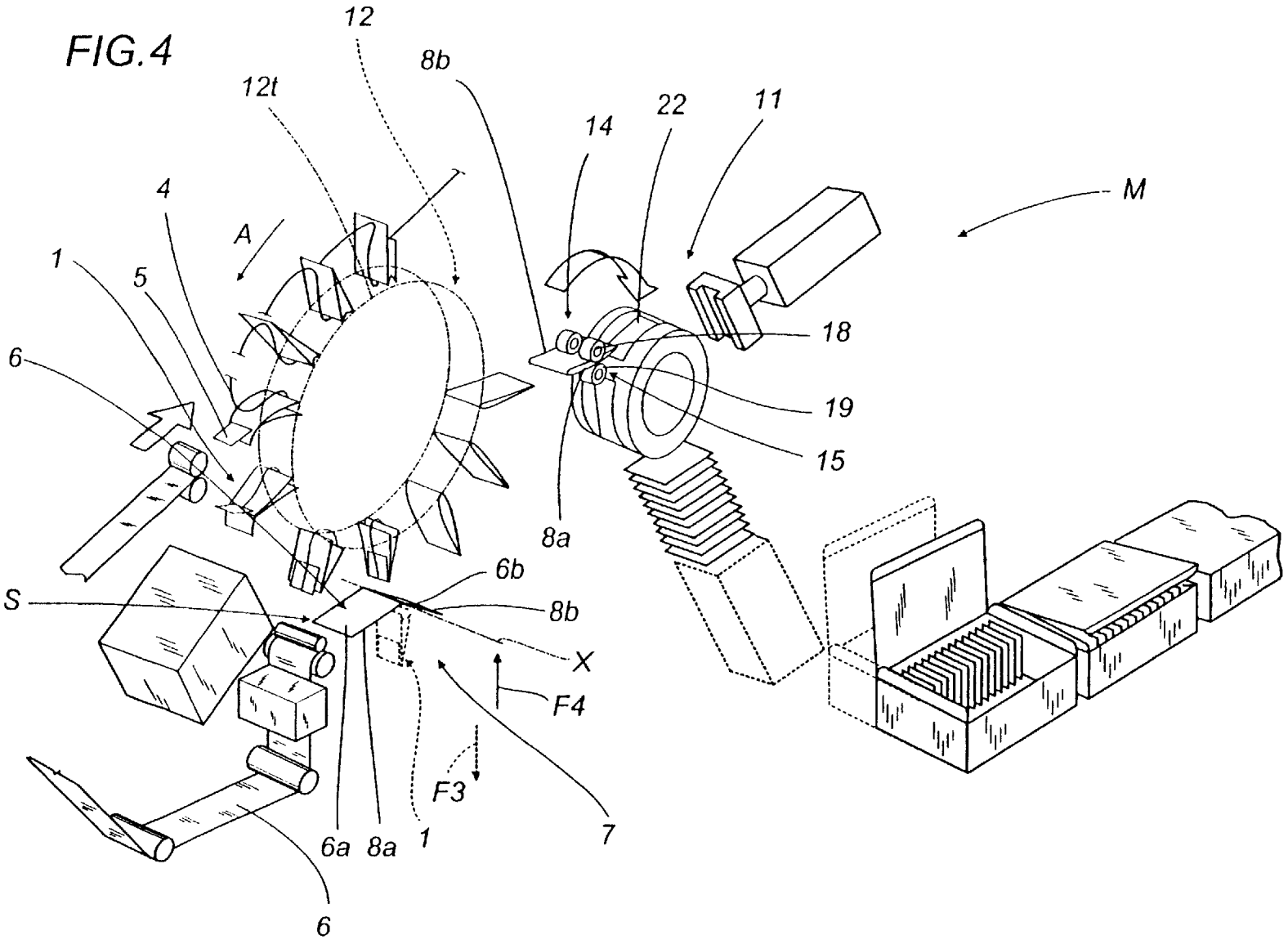
FIG. 4 is a schematic perspective view, with some parts cut away for clarity, of a part of a machine for making filter bags and wrapping them in individual sealed outer envelopes according to the present invention.

The method described above is implemented by the machine M illustrated in FIG. 4. The specific part of the machine to which the present invention relates comprises handling means 12 for moving the filter bag 1 in a working direction A towards a plurality of stations for simultaneously completing the formation of the filter bag 1 with string 4 and pick-up tag 5.

Figure 7:
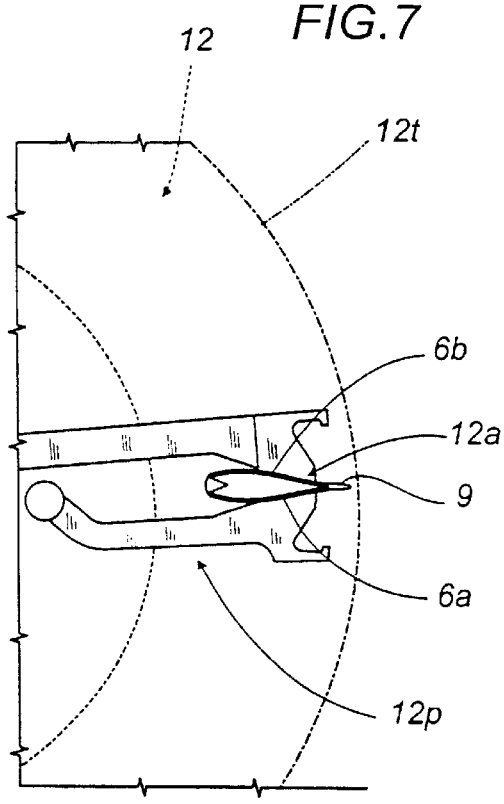
FIG. 7 is a scaled-up schematic side view of a part of the machine illustrated in FIGS. 4, 5 and 6.

In particular, as illustrated in FIG. 7, the handling means 12 comprise a rotary drum 12*p* equipped radially with a plurality of gripper elements 12*p* for picking up, handling and releasing the individual filter bags 1 and designed to carry each filter bag 1 to the wrapping station 7. The station 7 is equipped with means (of known type and therefore not illustrated) for folding the sheet 6 into a U shape about a transversal axis X of it, so as to form the two wings 6*a* and 6*b*.

After the station 7, there is a station 11 for joining the superposed longitudinal edges 8*a* and 8*b* of the U-shaped sheet 6 to form a sealed outer envelope S.

As shown clearly in FIG. 4, between the wrapping station 7 and the station 11 for joining the longitudinal edges 8*a* and 8*b*, there is a station 14 for rolling the longitudinal edges 8*a* and 8*b* in order to flatten them.

If the sheets 6 used have edges 8*a*, 8*b* and 10*a*, 10*b* with cold glue on them, the rolling station 14 also constitutes the station 11 for joining the longitudinal edges 8*a* and 8*b*. In other words, the station 11 is not used (that is, it is disabled or not fitted to the machine).

Figure 6:
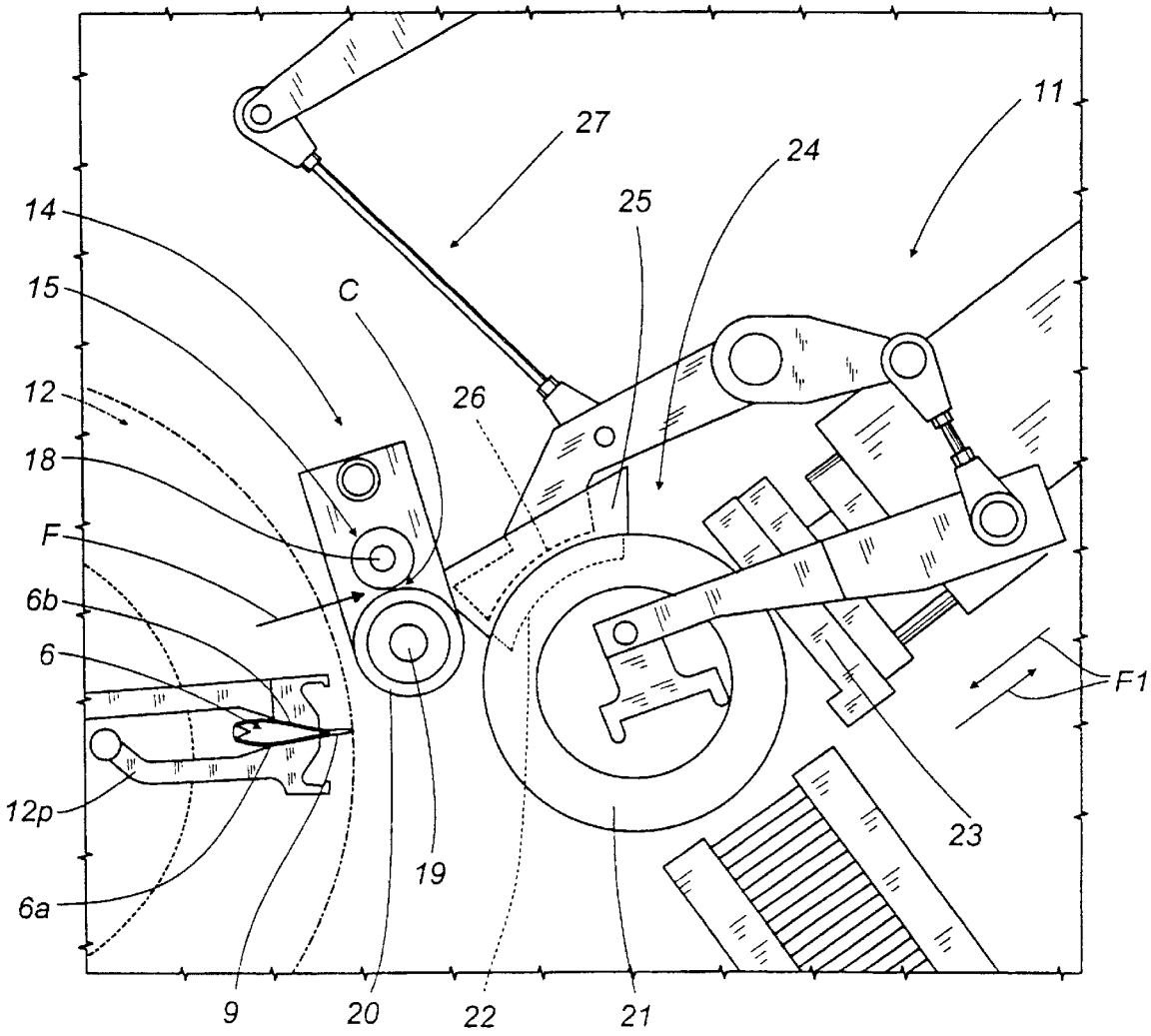
FIG. 6 is a schematic side view, with some parts cut away in order to better illustrate others, of an operating station forming part of the machine shown in FIGS. 4 and 5.

As illustrated in FIGS. 4, 5 and 6, the rolling station 14 comprises roller means 15 for the simultaneous and bilateral rolling of the longitudinal edges 8*a* and 8*b* so as to align the longitudinal edges 8*a* and 8*b* prior to being joined or to actually join them.

As shown in more detail in FIG. 7, if the sealed outer envelope S has an opening flap 9, each gripper 12*p* forming part of the handling means 12 comprises a presser element

12*a* which keeps the flap 9 in a fixed position against the outer surface of the wing 6*b* until it gets near the rolling station 14.

Instead, if the outer envelope S is of the type sealed on three sides or edges, there is a station 16 for joining the top edges 10*a* and 10*b* of the sheet 6 by heal sealing or by simply pressing them together. The station 16 is located, relative to the working direction A, after the wrapping station 7 and before the rolling station 14. The joining station 16 (see FIG. 5) comprises a gripper element 17 with heated jaws, in the event of heat sealed outer envelope, designed to heat seal the top ends 10*a* and 10*b* of the sheet 6 which is folded into a U shape.

The rolling station 14, illustrated in more detail in FIG. 6, comprises two opposite pairs of rollers 18 and 19 (shown schematically also in FIGS. 4 and 5) The roller pairs 18 and 19 are supported by a bridge structure 20 forming a channel C to allow the sheet 6 folded into a U shape to pass through in a radial direction of feed F away from the grippers 12*p*.

The roller pairs 18 and 19 are located on the sides of the bridge structure 20 and the rollers of each pair are in tangential contact with each other in such a way as to flatten the sheet 6 folded into a U between them while feeding it to the station 11 where the longitudinal edges 8*a* and 8*b* are joined.

The joining station 11, which operates only if the edges 8*a* and 8*b* are heat sealed, comprises a rotary drum 21, whose outer surface has recesses 22 formed in it to accommodate the single sheets 6 wrapped in a U around the filter bags 1 feeding in from the rolling station 14, and a pressure head 23 mounted radially relative to the drum 21 and designed to join the longitudinal edges 8*a* and 8*b*, each recess 22 being moved to a position facing the head 23 and the head 23 then being moved towards and pressed against it (see arrows F1 in FIG. 6).

If the sealed outer envelope S is of the type illustrated in FIGS. 1 and 2, the pressure head 23 comprises a knurled presser element 23 of known type designed to 3 minimize edges 8*a* and 8*b* by knurling, acting in conjunction with the recesses 22, which are also preferably knurled.

Instead, if the sealed outer envelope S is of the type illustrated in FIG. 3, the pressure head 23 comprises a heated element 23 designed to join the edges 8*a* and 8*b* by heat sealing.

Close to the drum 21, there are means 24 designed to guide the U-shaped sheet 6 as it feeds out of the rolling station 14 so that the sheet 6 is accommodated securely in the recess 22 prior to the joining operation performed by the head 23, which is angularly spaced relative to the guide means 24.

The guide means 24 comprise a frame 25 closed on at least three sides, located close to the drum 21 to delimit an area through which the U-shaped sheet 6 feeds out of the rolling station 14 and where a recess 22 is already positioned.

In addition to the frame 25, the guide means 24 may comprise a presser element 26 fitted above the frame 25 to form a top closure operated by suitable synchronised drive means 27 that move it between a raised position where the element 26 is away from the recess 22 and a lowered position where the element 26 is in contact with a single U-shaped sheet 6 feeding out of the rolling station 14 so as to locate it in the recess 22.

The method and the related machine described above therefore achieve the above mentioned aims by introducing a rolling station that flattens the longitudinal edges of the sheet so as to align and correctly position the edges over each other before the step of heat sealing them.

The method provides sealed outer envelopes of high quality and without crinkled edges.

Also, the rolling station introduced does not increase the complexity of the machine M since it is simply placed between the starwheel and an existing roller on the machine, even if it is now also used for sealing and not only to convey the sealed outer envelopes to further cartoning stations.

Furthermore, it should be stressed that the rollers also act as feed means between the starwheel and the longitudinal sealing roller, which means that the rolling station has a twofold function.

Moreover, if the sheets 6 being used are or the type with cold glue on them, the rolling station also functions as the sealing station where the edges can be joined by simply pressing them together, thus simplifying the structure of the machine.

The use of rollers to flatten the edges of the outer envelope improves the quality of the end product because even if the material used is relatively rigid, the edges remain properly in place until they reach the point where the final seal is made.

The invention described can be subject to modifications and variations without thereby departing from the scope of the inventive concept. Moreover, all the details of the invention may be substituted by technically equivalent elements.

I claim:

1. A method for wrapping filter bags for products for infusion in individual sealed outer envelopes, the filter bags comprising at least one chamber containing a charge of product, and a string connected at one end to the chamber, while the other end of the string is connected to a pick-up tag, the method comprising the following steps:

feeding a succession of single, plane sheets to a station for wrapping each sheet over a corresponding filter bag;

folding each sheet into a U-shape about a transversal axis of said each sheet around the filter bag so as to form at least two opposite wings between which the filter bag is placed; and joining at least longitudinal edges of said each sheet that is folded into a U shape to form a sealed outer envelope around the filter bag, wherein after the step of folding the sheet, the method further comprises a step of aligning the longitudinal edges with each other by simultaneously rolling the longitudinal edges.

2. The method according to claim 1, wherein the step of rolling the longitudinal edges is performed between the step of folding the sheet and the step of joining the longitudinal edges.

3. The method according to claim 2, wherein the rolling step is performed while the sheet, which is folded into a U shape around the filter bag, is being fed to a station where the longitudinal edges are joined.

4. The method according to claim 1, where said each sheet has parts with cold glue, wherein the step of rolling the longitudinal edges also includes the step of joining the longitudinal edges which are the parts having the cold glue.

5. The method according to claim 1, wherein the sheet folded into a U shape also includes an opening flap, extending from one of the at least two wings and formed by folding over a portion of said one of the at least two wings in such a way that an inner surface of said folded portion of said one of the at least two wings comes into contact with an outer surface of another of the at least two wings; the rolling step being performed also on the longitudinal outer edges of an opening flap so as to also align the longitudinal outer edges with underlying longitudinal edges of the U-shaped sheet.

6. The method according to claim 1, where said each sheet has parts with cold glue, is folded into a U shape, has an opening flap extending from one wing, and is formed by folding a portion of the one wing over such that an inner surface of said portion comes into contact with an outer surface of the other wing; the rolling step also being performed on longitudinal outer edges of the opening flap with cold glue so as to also align said longitudinal outer edges with and join said longitudinal outer edges to underlying longitudinal edges of the U-shaped sheet.

7. The method according to claim 1, wherein the step of joining the longitudinal edges is performed after the rolling step which precedes a further step of joining top transversal edges of the wings of the U-shaped sheet.

8. The method according to claim 7, wherein the joining is effected by heat sealing.

9. The method according to claim 7, where said each sheet has parts with cold glue the joining is effected by pressing.

10. A machine for wrapping filter bags for products for infusion in individual sealed envelopes, the filter bags comprising at least one chamber containing a charge of product and a string connected at one end to the chamber, while the other end of the string is connected to a pick-up tag, the machine comprising handling means for moving each filter bag in a working direction towards a station for wrapping a single, plane sheet of wrapping material around the filter bag; means for folding the sheet of wrapping material about a transversal axis of the sheet to form a U-shaped wrapping around the filter bag, with at least two opposite wings between which the filter bag is placed; and a station for joining at least two longitudinal edges of the U-shaped wrapping sheet to form a single sealed envelope around the filter bag; wherein the machine further comprises, after the wrapping station, at least a rolling station which comprises roller means for simultaneously rolling the longitudinal edges and aligning the longitudinal edges with each other.

11. The machine according to claim 10, wherein the station for rolling the longitudinal edges is located between the wrapping station and the joining station.

12. The machine according to claim 10, where each sheet has parts with cold glue and the station for rolling the longitudinal edges further includes the joining station and the rolling station presses together the longitudinal edges with the cold glue to join the longitudinal edges.

13. The machine according to claim 10, further comprising means for forming a flap from one of the wings on the U-shaped sheet by folding a portion of the one wing over such that an inner surface of said portion comes into contact with an outer surface of the other wing; the filter bag handling means comprising a presser element which keeps the flap in a fixed position against the outer surface of the other wing at least until the U-shaped sheet nears the rolling station.

14. The machine according to claim 10, wherein between the wrapping station and the rolling station there is a further station for joining the top transversal edges of the U-shaped sheet.

15. The machine according to claim 14, wherein the further joining station comprises a heated gripper element to heat seal the top transversal edges of the U-shaped sheet.

16. The machine according to claim 14, where each sheet has parts with cold glue and the further joining station comprises a gripper element to press together the top transversal edges of the U-shaped sheet having cold glue thereon.

17. The machine according to claim 10, wherein the rolling station comprises two opposite pairs of rollers, is supported by a bridge structure forming a channel to allow the sheet, which is folded into a U shape, to pass through in a radial feed direction away from the handling means; the roller pairs being located at ends of the channel and rollers of each roller pair being in tangential contact with each other in such a way as to flatten the sheet folded into a U shape between the roller pairs while at the same time feeding the sheet forward.

18. The machine according to claim 10, wherein the station for joining the longitudinal edges comprises a rotary drum having an outer surface with recesses that accommodate the single sheets wrapped in a U shape around the filter bags being fed by the rolling station, and a pressure head radially mounted relative to the rotary drum and joins the longitudinal edges, each recess being moved to a position facing the pressure head and the pressure head then being moved towards and pressed against said each recess.

19. The machine according to claim 18, wherein the pressure head) comprises a heated element that joins the longitudinal edges by heat sealing.

20. The machine according to claim 18, wherein the drum is acted upon by means that guide the U-shaped sheet as the sheet is fed out of the rolling station so that the sheet is accommodated securely in the recess prior to a joining operation performed by the pressure head, which is angularly spaced relative to the guide means.

21. The machine according to claim 20, wherein the guide means comprise a frame closed on at least three sides located close to the drum to delimit an area having a recess and through which the U-shaped sheet is fed out of the rolling station.

22. The machine according to claim 21, wherein the guide means further comprises a presser element fitted above the frame to form a top closure operated by suitable synchronized drive means that move the presser element between a raised position where the element is away from the recess and a lowered position where the element is in contact with a single U-shaped sheet being fed out of the rolling station so as to locate the presser element in the recess.

* * * * *